US008234964B1

(12) United States Patent
Wynne et al.

(10) Patent No.: US 8,234,964 B1
(45) Date of Patent: Aug. 7, 2012

(54) EDS FRAGMENT REMOVAL TOOL

(75) Inventors: Paul C. Wynne, Little Rock, AR (US); Dale Michael McClellan, Bryant, AR (US); Brad R. Branson, Pine Bluff, AR (US); Joe T. Green, Rison, AR (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 235 days.

(21) Appl. No.: 12/755,728

(22) Filed: Apr. 7, 2010

(51) Int. Cl.
*F42B 33/06* (2006.01)

(52) U.S. Cl. ..... 86/50; 588/900; 588/403; 588/401

(58) Field of Classification Search ..... 86/50; 588/401, 588/403, 249.5, 900
See application file for complete search history.

(56) References Cited

U.S. PATENT DOCUMENTS

| | | | | |
|---|---|---|---|---|
| 2,315,800 | A * | 4/1943 | Rochester et al. | 109/23 |
| 3,721,201 | A * | 3/1973 | Boller | 109/49.5 |
| 3,800,715 | A * | 4/1974 | Boller | 109/49.5 |
| 3,820,435 | A * | 6/1974 | Rogers et al. | 89/1.1 |
| 6,881,383 | B1 * | 4/2005 | Tschritter et al. | 422/165 |
| 7,637,194 | B2 * | 12/2009 | Gude et al. | 86/50 |
| 7,819,046 | B2 * | 10/2010 | Ohlson | 86/50 |
| 7,820,870 | B2 * | 10/2010 | Singh et al. | 588/16 |

* cited by examiner

*Primary Examiner* — James Bergin
(74) *Attorney, Agent, or Firm* — Ulysses John Biffoni

(57) ABSTRACT

The present invention relates to mechanical devices and methods allowing the safe removal of heavy, difficult to handle fragments from an explosive destruction system (EDS).

14 Claims, 1 Drawing Sheet

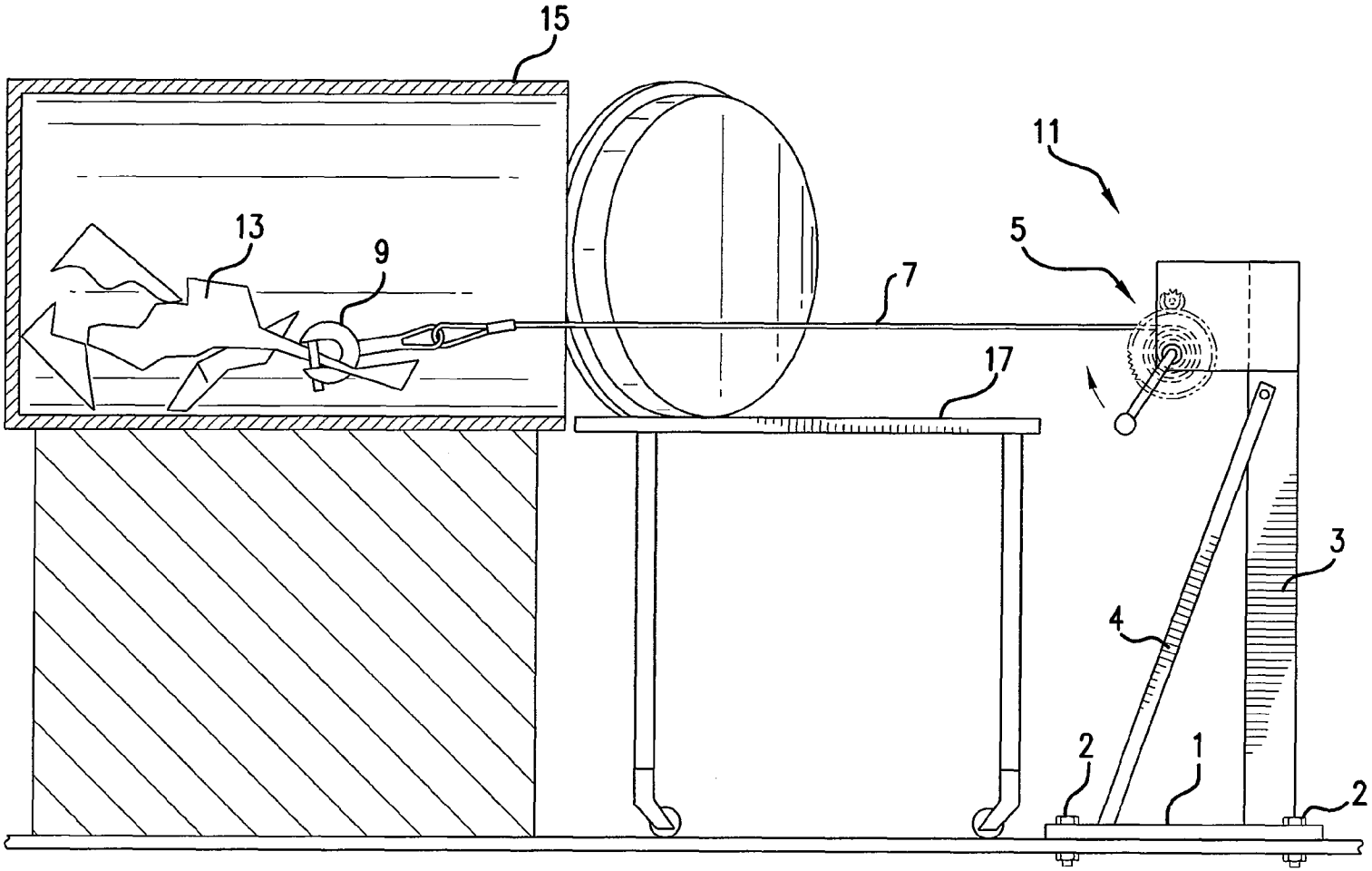
11
5
7
15
9
13
17
4
3
1
2
2

EDS FRAGMENT REMOVAL TOOL

GOVERNMENTAL INTEREST

The invention described herein may be manufactured, used, and licensed by or for the U.S. Government.

BACKGROUND OF THE INVENTION

The United States Department of Defense is required under Public Law 102-484, Section 176, to safely destroy all U.S. non-stockpile chemical warfare material (NSCWM). The priority for destroying NSCM has increased because of the Chemical Weapons Convention (CWC) negotiations and the realization that some Chemical Warfare Material (CWM) are in the public domain while others are located close to public areas.

A number of devices have been created to safely remove NSCWM from the environment. One device known as an Explosive Destruction System (EDS) was designed at the Sandia National Laboratory. This EDS was conceived and owned by the Program Manager for Non Stockpile Chemical Material (PMNSCM), and operated by Edgewood Chemical Biological Center (ECBC), at the Pine Bluff Arsenal (PBA), and elsewhere throughout the United States. A description of an EDS is further provided in Tschritter et al., U.S. Pat. No. 6,881,383 and incorporated herein by reference. The purpose of an EDS is to explosively access and chemically treat a variety of munitions including large items such as rockets. During the treatment of NSCWMs, fragments are formed and become entangled creating a single large mass that must be removed. The EDS was not designed for easy removal of these large, heavy fragments and, in order for it to be used again, humans must physically remove fragments from the containment vessel and place them into a waste collection area between treatments. Tools that can assist in the safe removal of large, heavy fragments between treatments are needed.

SUMMARY OF THE INVENTION

Accordingly, it is an object of the present invention to develop tools that safely remove fragments (or scraps) from an EDS vessel while avoiding the risk of ergonomic or physical injury to humans. One embodiment of the present invention is a removal tool comprising: (a) a base comprising a top surface and a bottom surface, (b) a securing means attachable to the base, (c) a post comprising a top surface and a bottom surface and wherein the top surface of the base is connected to the bottom surface of the post, (d) a mechanical pulling means connected to the post; (e) a cable means attached to the mechanical pulling means; and (f) an attachment means connected to the cable means. It is preferred that the mechanical pulling means is selected from the group consisting of pulleys, strap-based winches, chain winches and combinations thereof. It is also preferred that the cable means comprises a chain, belt, strap, cord, or cable. It is also preferred that the removal tool is capable of removable attachment to a floor by the securing means and that the floor is an EDS platform. In operation, the removal tool may be secured on the floor in front of the door of an EDS vessel and then be removed when necessary. It is also preferred that the removal tool further comprises a supporting means whereby one end of the supporting means is attached to the base and the other end of the supporting means is attached to the post. The removal tool is specifically designed to extract scrap (including large, heavy fragments) created after the treatment of a munition within an EDS vessel.

Another embodiment of the present invention is a method of treating munitions comprising the steps of: (a) obtaining an EDS vessel; (b) obtaining a removal tool of the present invention; (c) obtaining one or more munition(s); (d) placing the one or more munition(s) within the EDS vessel; (e) performing the EDS treatment process thereby creating one or more fragments within the EDS vessel; and (f) removing the one or more fragments from the EDS vessel with a removal tool of the present invention. It is preferred that this method further comprises the steps of: (g) obtaining a table; (h) placing the one or more fragments on a table after removing the one or more fragments from the EDS vessel, and (i) disassembling the one or more fragments on the table.

Another embodiment of the present invention is a method of removing fragments from an EDS vessel comprising the steps of: (a) obtaining an EDS vessel having an interior and exterior wherein one or more fragments of treated munitions are present within the interior of the EDS vessel; (b) attaching a removal tool of the present invention to the platform of the EDS vessel; (c) obtaining a table and placing the table between the EDS vessel and the removal tool; (d) attaching the attachment means of the removal tool to the one or more fragments; and (e) winding the mechanical pulling means so as to move the one or more fragments across the interior of the EDS vessel and on to the table; and (f) disassembling the one or more fragments and disposing of the pieces.

BRIEF DESCRIPTION OF THE DRAWINGS

FIG. 1 provides a side view of one embodiment of the present invention, specifically an EDS Fragment Removal Tool.

DETAILED DESCRIPTION OF THE INVENTION

Reference will now be made to preferred embodiments of this invention, examples of which will be obvious from the description of the invention. The current invention relates to methods and devices useful for the safe removal of heavy and difficult to handle fragments left over from EDS operations. In order to better understand the invention, the following terms have been defined:

The term "EDS" means an explosive destruction system such as the one described in Tschritter, et al., U.S. Pat. No. 6,881,383.

The term "munition" includes armaments, ammunition, and more specifically chemical warfare material and non-stockpile chemical warfare material.

The term "stockpile" includes a storage pile and more specifically a reserve supply of a material, such as munitions, accumulated within a country for use as during a shortage or combat.

The term "non-stockpile" includes a material, such as munitions, that is no longer required to be accumulated within a country.

The term "toxic agent" includes things harmful to living organisms such as chemical and/or biological agents that are harmful to humans.

EDS Fragment Removal Tool

Turning now to FIG. 1, a side view of an EDS fragment removal tool (11) is shown. The system comprises a base (1) that is capable of being attached to the floor of an EDS. As shown in FIG. 1, the base (1) has at least two sides whereby the bottom side of the base (1) is attached to the floor (or platform) in front of an EDS vessel (15) by a securing means (2) and the top side of the base is attached to a post (3). The securing means (2) may include fasteners, clamps, clips, buckles, ties, snaps, etc., or any combination thereof. The base (1) may also be attached to a supporting means (4) whereby one end of the supporting means (4) is attached to the base (1) and the other end of the supporting means (4) is attached to the post (3). The post (3) has at least two sides whereby the bottom side of the post (3) is attached to the base (1) and the top side of the post (3) is attached to a mechanical pulling means (5) which is preferably above the center of mass to be pulled. The mechanical pulling means (5) may be pulleys, strap-based winches, chain based winches or a combinations thereof. The mechanical pulling means (5) is attached to one end of a cable means (7) which typically comprises a chain, belt or a strap capable of pulling large and heavy objects. Attached to the other end of the cable means (7) is an attachment means (9) such as a plate clamp, hook, fastener, clasp, tie, buckle, etc., or a combination thereof, capable of being attached to fragments (13) found in an EDS vessel (15), specifically large and heavy fragments or scraps. To better understand how a removal tool of the present invention is used in combination with an EDS treatment process, a brief description of a typical EDS treatment process is provided. The specific steps of an EDS treatment process may vary depending upon the munition(s) being treated.

EDS Treatment Process

A munition(s), such as a NSCM containing a toxic agent, is loaded into a fragment suppression shield (FSS) preferably on a Teflon table (17) with Teflon feet located on a deck in front of an EDS vessel (15). Once the FSS is assembled, the FSS and munition(s) are pushed off of the table (17) into the EDS vessel (15). Explosives are one component of the FSS and in order to detonate the explosives cables are attached to these explosives. These cables are also attached to the EDS door. When the cables are secured on the FSS explosives and EDS door, the EDS door is closed. Prior to detonation of these explosives, all personnel are evacuated from the surrounding area and then a remote firing system is used to detonate the explosives. The blast from the explosives must be strong enough to cut open the munition(s). Should the munition(s) include a toxic agent, then the toxic agent must be neutralized so that operators may open the EDS vessel (15) without harm to remove the treated munition(s), typically large, heavy fragments (13). A neutralizing reagent is placed within the EDS vessel (15) and the EDS vessel (15) is rotated and heated for a period of time required to neutralize the toxic agent. Before the EDS door is opened a closed loop sample of the liquid neutralizing reagent solution, present in the interior of the EDS vessel (15), is taken and then analyzed to confirm that the toxic agent is destroyed. Should it be confirmed that the toxic agent has been neutralized, then the neutralizing reagent is drained from the EDS vessel (15). Next, the EDS vessel (15) is filled with water and is rinsed for a prescribed period of time and at a specified temperature. Then the water is drained from the EDS vessel (15). An operator opens the door and then removes scrap metal, or fragments (13), from the EDS vessel (15).

Use of EDS Fragment Removal Tool

At the completion of the EDS treatment, the EDS vessel (15) is opened. Next an operator secures a standard work table (17), preferably a Teflon table, to the EDS platform immediately in front of the vessel (15) door. It is preferred that the tool (11) of the present invention is secured to the EDS platform behind the table (17) so that the table (17) is between the tool (11) and the EDS vessel (15). Once the tool (11) is secured to the platform, an operator attaches the attaching means (9) of the tool (11) to one or more fragments (13) present in an EDS vessel (15). An operator then uses the mechanical pulling means (5) to move the scrap, or fragments (13), from the EDS vessel (15). It is preferred that the mechanical pulling means (5) includes a crank handle, to be turned by an operator to retract the strap, or cable means (7), connected to the scrap by the attaching means (9). This crank handle is preferably locked at first while the operator is connecting the attachment means (9) to a piece of scrap. Then, in order to retract the cable or line (7), the crank handle is turned so that the line of pull is above the center of mass of the fragment (13), lifting it slightly, so that it makes a smooth transition on to the work table (17). Operators preferably maintain positive control of the fragment (13) so that it continues in a straight line on to the work table (17). Treated munitions may result in scrap metal exceeding 800 lbs, which may be removed from an EDS vessel (15) using a tool (11) of the present invention.

One advantage of a tool (11) of the present invention is that it is easily removable. The tool (11) can be secured to the floor (or EDS platform) in front of an EDS vessel (15) to allow an operator to remove treated scraps, or fragments (13), from and EDS vessel (15). Then the tool of the present invention (11) may be removed from the floor in front of the EDS vessel (15) so that untreated munitions may be placed into an EDS vessel (15) prior to the start of a treatment process. One embodiment of the EDS fragment removal tool (11) has been designed to take up little space. This way a tool (11) of the present invention may be optimally positioned on the floor in front of an EDS vessel (15) so as to make the removal of fragments (13) as easy as possible. The tool is used to provide mechanical assistance to operators and improve the ergonomics of unloading heavy scrap material from the vessel.

Example 1

Use of Removal Tool

Using the methods described above, German Traktor Rockets were treated in an EDS vessel and the remaining scrap was removed using a tool of the present invention. The German Traktor Rockets were placed into a Fragment Suppression Shield (FSS) that was made up of multiple layers of steel and then placed into an EDS vessel to undergo treatment. After treatment of the rockets, the resulting mass, or scrap, found within the EDS vessel was approximately 800 lbs including the remains of the FSS containing the German Traktor rockets. This mass, or scrap, was removed from the EDS vessel using a tool of the present invention. Upon removal of the scrap from the EDS vessel onto a work table, operators disassembled the scrap and then disposed of the material. The pieces present on the table after disassembly were manageable by an operator without mechanical assistance.

The foregoing description of embodiments of the present invention provides an exemplary illustration and description, but is not intended to be exhaustive or to limit the invention to the precise form disclosed. Modifications and variations are possible in light of the above teachings or may be acquired from practice of the invention.

REFERENCES

Tschritter, et al, U.S. Pat. No. 6,881,383 issued Apr. 19, 2005

All patent, patent applications, and publications mentioned are incorporated by reference in their entirety into this application.

What is claimed is:

1. A method of treating munitions comprising the steps of:
(a) obtaining an EDS vessel;
(b) obtaining a removal tool comprising: a base having a top surface and a bottom surface, a securing means attachable to the base, a post having a top surface and a bottom surface wherein the top surface of the base is connected to the bottom surface of the post, a mechanical pulling means connected to the post, a cable means attached to the mechanical pulling means, and an attachment means connected to the cable means;
(c) obtaining one or more munition(s);
(d) placing the one or more munition(s) within the EDS vessel;
(e) performing the EDS treatment process thereby creating one or more fragments within the EDS vessel; and
(f) removing the one or more fragments from the EDS vessel with said removal tool.

2. The method of claim 1, further comprising the steps of:
(g) obtaining a table; and
(h) placing the one or more fragments on said table after removing the one or more fragments from the EDS vessel with said removal tool.

3. The method of claim 2, further comprising the step of:
(i) disassembling the one or more fragments on the table.

4. The method of claim 1, wherein said removal tool is attached to a platform of the EDS vessel.

5. The method of claim 1, wherein the removal tool further comprises a supporting means whereby one end of the supporting means is attached to the base and the other end of the supporting means is attached to the post.

6. The method of claim 1, wherein the mechanical pulling means is selected from the group consisting of pulleys, strap based winches, chain winches and combinations thereof.

7. The method of claim 1, wherein the cable means is selected from the group consisting of a chain, strap, belt, cord or cable.

8. The method of claim 1, wherein the attachment means is selected from the group consisting of a plate clamp, hook, fastener, clamp, tie or buckle.

9. A method of removing fragments from an EDS vessel, comprising the steps of:
(a) obtaining an EDS vessel having an interior and exterior wherein one or more fragments of treated munitions are present within the interior of the EDS vessel, and wherein the EDS vessel includes a platform;
(b) attaching a removal tool comprising: a base having a top surface and a bottom surface, a securing means attachable to the base, a post having a top surface and a bottom surface wherein the top surface of the base is connected to the bottom surface of the post, a mechanical pulling means connected to the post; a cable means attached to the mechanical pulling means; and an attachment means connected to the cable means, to the platform of the EDS vessel;
(c) obtaining a table and placing the table between the EDS vessel and the removal tool;
(d) attaching the attachment means of the removal tool to the one or more fragments; and
(e) winding the mechanical pulling means so as to move the one or more fragments across the interior of the EDS vessel and onto the table.

10. The method of claim 9, further comprising:
(f) disassembling the one or more fragments and disposing of the pieces.

11. The method of claim 9, wherein the removal tool further comprises a supporting means whereby one end of the supporting means is attached to the base and the other end of the supporting means is attached to the post.

12. The method of claim 9, wherein the mechanical pulling means is selected from the group consisting of pulleys, strap based winches, chain winches and combinations thereof.

13. The method of claim 9, wherein the cable means is selected from the group consisting of a chain, strap, belt, cord or cable.

14. The method of claim 9, wherein the attachment means is selected from the group consisting of a plate clamp, hook, fastener, clamp, tie or buckle.

* * * * *